US006326867B1

(12) United States Patent
Lee et al.

(10) Patent No.: US 6,326,867 B1
(45) Date of Patent: Dec. 4, 2001

(54) DIELECTRIC FILTER HAVING RESONATORS ARRANGED IN SERIES

(75) Inventors: Chang Hwa Lee; Bon Hee Koo; O Gon Chun; Dong Seok Jeon; Sang Seok Lee, all of Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 0 days.

(21) Appl. No.: 09/475,124

(22) Filed: Dec. 30, 1999

(30) Foreign Application Priority Data

Nov. 23, 1999 (KR) ..... 99-52217

(51) Int. Cl.[7] ..... H01P 1/20; H01P 5/12

(52) U.S. Cl. ..... 333/206; 333/202; 333/134

(58) Field of Search ..... 333/202, 206, 333/134

(56) References Cited

U.S. PATENT DOCUMENTS

| | | | | |
|---|---|---|---|---|
| 4,733,208 | | 3/1988 | Ishikawa et al. | 333/202 |
| 5,208,565 | | 5/1993 | Sogo et al. | 333/206 |
| 5,396,201 | | 3/1995 | Ishizaki et al. | 333/204 |
| 5,929,721 | * | 7/1999 | Munn et al. | 333/134 |
| 6,133,808 | * | 10/2000 | Akakawa | 333/134 |

FOREIGN PATENT DOCUMENTS

| | | | |
|---|---|---|---|
| 62-213301 A | * | 9/1987 | (JP) . |
| 404302503 A | * | 10/1992 | (JP) . |
| 406006109 A | * | 1/1994 | (JP) . |

OTHER PUBLICATIONS

Sagawa, et al.; Miniaturized Antenna Duplexers for Portable Radio telephone Terminals; 1990; pp. 417–420.

Ishizaki, et al.; A Stepped Impedance Comb–Line Filter Fabricated by Using Ceramic Lamination Technique; Apr. 1994.

Matsumoto, et al.; A Miniaturized Dielectric Monoblock Band–Pass Filter for 80 MHz Band Cordless telephone System; Apr. 1994; pp. 249–252.

* cited by examiner

*Primary Examiner*—Robert Pascal
*Assistant Examiner*—Patricia T. Nguyen
(74) *Attorney, Agent, or Firm*—Jacobson Holman, PLLC

(57) ABSTRACT

The present invention provides a dielectric filter having a dielectric block, and a plurality of resonators formed within the dielectric block, each of the resonators having a first and second through holes formed vertically through the dielectric block and arranged in series along longitudinal axis of the dielectric block and a coupling portion electrically connecting an end of the first through hole to an end of the second through hole.

18 Claims, 10 Drawing Sheets

DIELECTRIC FILTER HAVING RESONATORS ARRANGED IN SERIES

FIELD OF THE INVENTION

The present invention relates to a dielectric filter which may be surface-mounted upon a substrate such as a printed circuit board and, more particularly, to a dielectric band-pass filter having resonators arranged in series for passing a specific frequency band of signals in radio communication transceiver.

DESCRIPTION OF THE PRIOR ART

Hereafter, various embodiments of conventional dielectric filters will be described schematically, referring to FIGS. 1 and 2.

The FIG. 1 is a perspective view showing an embodiment of the conventional dielectric filter having three resonators in single dielectric block.

The conventional dielectric filter shown in FIG. 1 includes a hexahedral dielectric block 101, which is coated with conductive material except the top surface and, a first, second and third resonators 102*a*, 102*b* and 102*c* vertically formed within the dielectric block 101.

Each of the resonators 102*a*, 102*b* and 102*c* is formed by a hole vertically through the dielectric block 101 and coated with conductive metal. Each of the resonators 102*a*, 102*b* and 102*c* functions as a short-circuited ¼ wavelength resonator.

Also, the conventional filter has two additional holes 103, which are positioned between the adjacent two resonators respectively, for adjusting a coupling magnitude between the resonators 102*a*, 102*b* and 102*c*. In this case, the holes 103 are not coated with the conductive metal.

Further, the conventional filter has conductive rods 104*a* and 104*b* inserted into the first and third resonators 102*a* and 102*c* and connected to input and output terminals respectively. In this case, a dielectric substance 105*a* is inserted between the first resonator 102*a* and the conductive rod 104*a*, and a dielectric substance 105*b* is inserted between the third resonator 102*c* and the conductive rod 104*b*. Each of the dielectric substances 105*a* and 105*b* couples the input and output terminals to the first and third resonators 102*a* and 102*c*.

In the conventional filter constructed as above-described, a signal transmitted from the input terminal is transferred to the first resonator 102*a* by an electromagnetic coupling between the first resonator 102*a* and the conductive rod 104*a*. Then, the signal in the first resonator 102*a* is transmitted to the second resonator 102*b* by electromagnetic coupling between the first and second resonators 102*a* and 102*b* and, continuously, to the third resonator 102*c* by an electromagnetic coupling between the second and third resonators 102*b* and 102*c*. Thereafter, the signal is transferred to the conductive rod 104*b* by the electromagnetic field coupling between the conductive rod 104*b* and the third resonator 102*c*.

In this case, the coupling magnitude between resonators may be adjusted by changing the size of the holes 103 or by displacing the position of the holes 103 in forward or backward of the dielectric block 101. Also, the number of the resonators may be increased so that a high attenuation characteristic can be achieved in the stop band.

However, the conventional dielectric filter as above-described has a plurality of problems as follows:

1) Since an additional process is required in order to prevent the holes from being coated with the conductive metal, the manufacturing cost of the conventional filter is high;

2) The signal transmitted into the filter may be transmitted to undesired position through opened surface (i.e., the top surface of the dielectric); and 3) When the number of the resonators is increased in order to achieve a high attenuation characteristic, an insert loss is increased and physical dimension of the filter is large.

The FIG. 2 is a perspective view showing another embodiment of the conventional dielectric filter having two resonators within a single dielectric block.

The conventional dielectric filter shown in FIG. 2 includes a dielectric block 201, two U-shaped resonators 202 and 203 vertically formed within the dielectric block 201, and an input and output terminals 204 and 205 disposed on side surface of the dielectric block 201. The two resonators 202 and 203 are positioned in parallel to longitudinal axis A–A' of the dielectric block 201 and to each other. That is, the two resonators 202 and 203 are arranged in a row.

The bottom surface of the dielectric block 201 consists of a coated portion 206 coated with a conductive material and a non-coated portion 207. Therefore, the U-shaped resonators 202 and 203 respectively have short-circuited portions 202*b* and 203*b* short-circuited to a ground plane, opened portions 202*c* and 203*c*, and coupling portions 202*a* and 203*a* for electrically connecting each of the short-circuited portions 202*b* and 203*b* to each of the opened portions 202*c* and 203*c*. At this time, each of the resonators 202 and 203 has a length corresponding to ¼ wavelength. In this case, the input and output terminals 204 and 205 are positioned adjacent to the non-coated portion 207 of the dielectric block 201.

However, the conventional filter may be miniaturized by decreasing the volume, but there is a problem that the height mounted on a printed circuit board is higher because the resonators are arranged in a row.

SUMMARY OF THE INVENTION

It is, therefore, an object of the present invention to provide a dielectric filter having resonators capable of decreasing the mounted height and improving an attenuation characteristic in a stop band.

In accordance with an aspect of the present invention, there is provided a dielectric filter having resonators arranged in series, comprising: a dielectric block; and a plurality of resonators formed within the dielectric block, each of the resonators having a first and second through holes formed vertically through the dielectric block and arranged in series along longitudinal axis of the dielectric block and a coupling portion electrically connecting an end of the first through hole to an end of the second through hole.

BRIEF DESCRIPTION OF THE DRAWINGS

The above and other objects and features of the present invention will become apparent from the following description of the preferred embodiments given in connection with the accompanying drawings, in which.

DETAILED DESCRIPTION OF THE PREFERRED EMBODIMENTS

Hereinafter, the present invention will be described in detail referring to the accompanying drawings.

Figure 1:
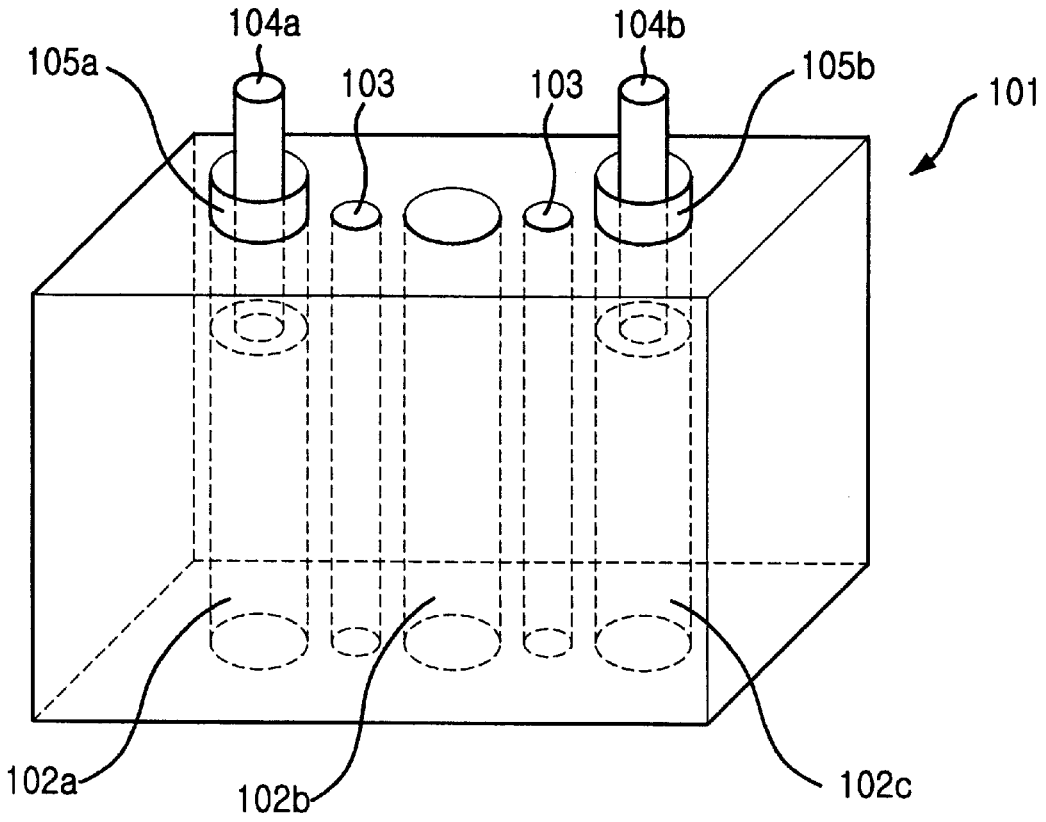
FIG. 1 (PRIOR ART)
FIG. 1 is a perspective view showing an embodiment of a conventional dielectric filter.
Figure 2:
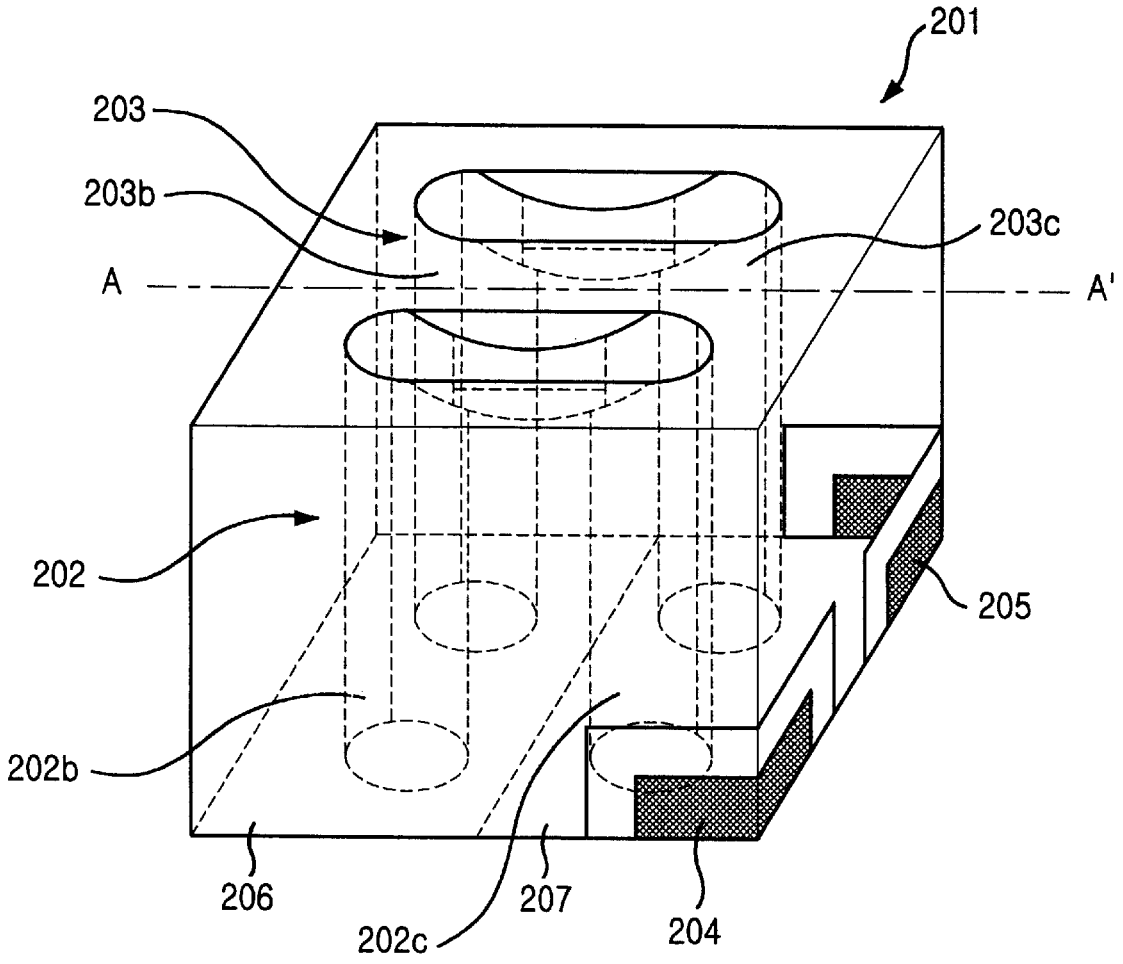
FIG. 2 (PRIOR ART)
FIG. 2 is a perspective view showing another embodiment of the conventional dielectric filter.
Figure 3:
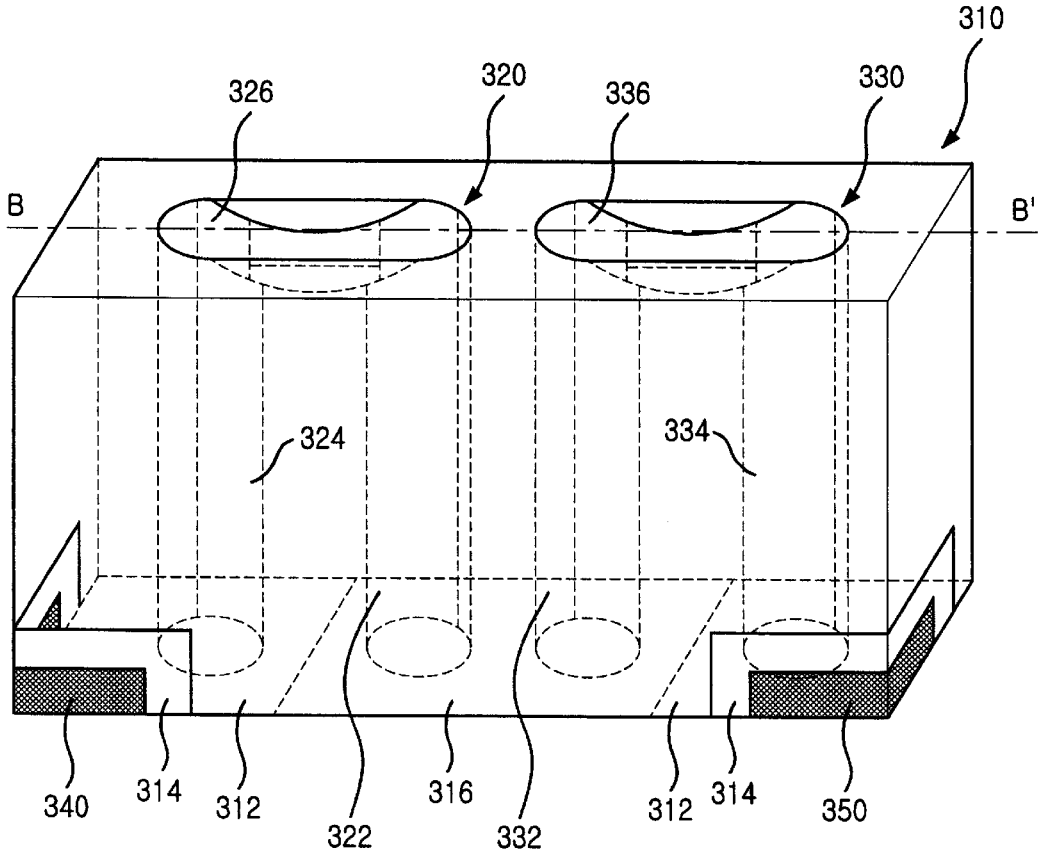
FIG. 3 is a perspective view illustrating a dielectric filter having resonators arranged in series according to a first embodiment of the present invention.
Figure 4:
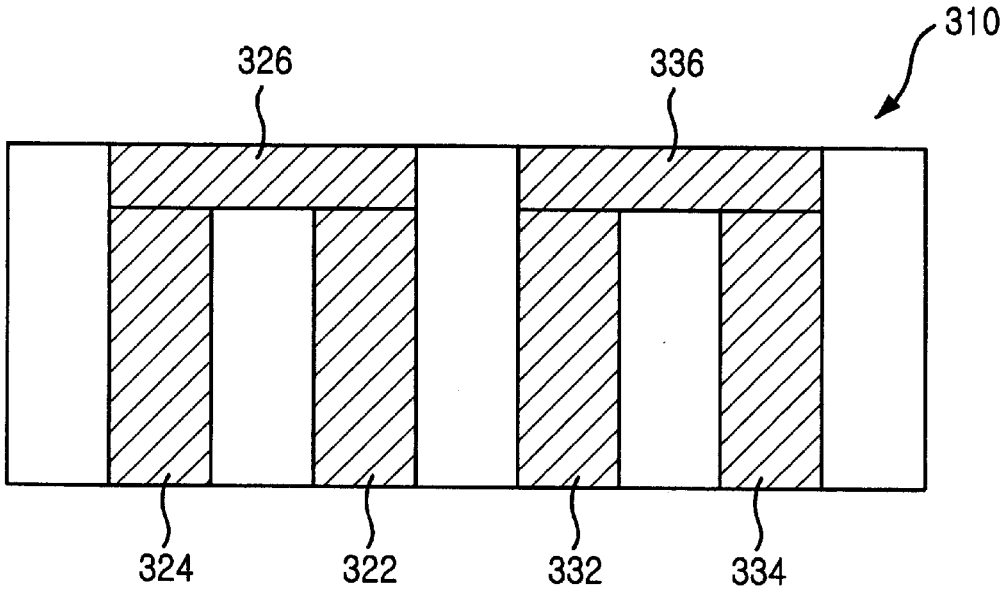
FIG. 4 is a cross-sectional view taken along longitudinal axis B–B' of the FIG. 3.
Figure 5:
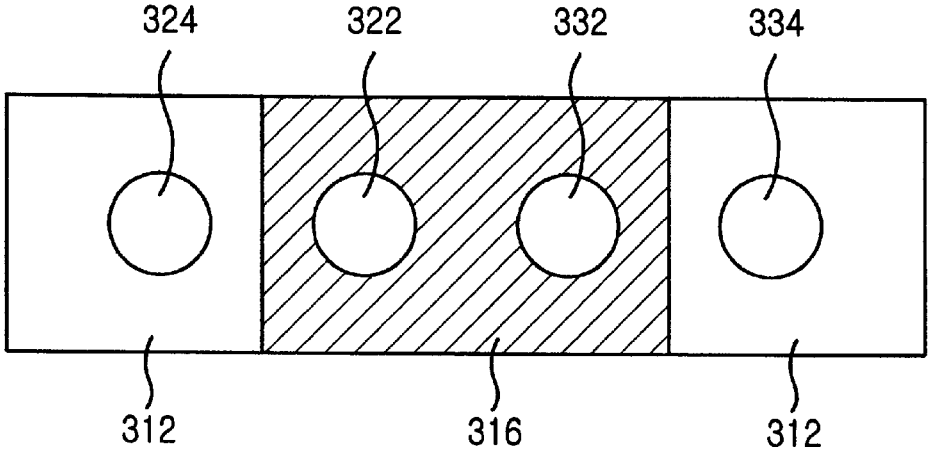
FIG. 5 is a bottom view of the FIG. 3.
Figure 6:
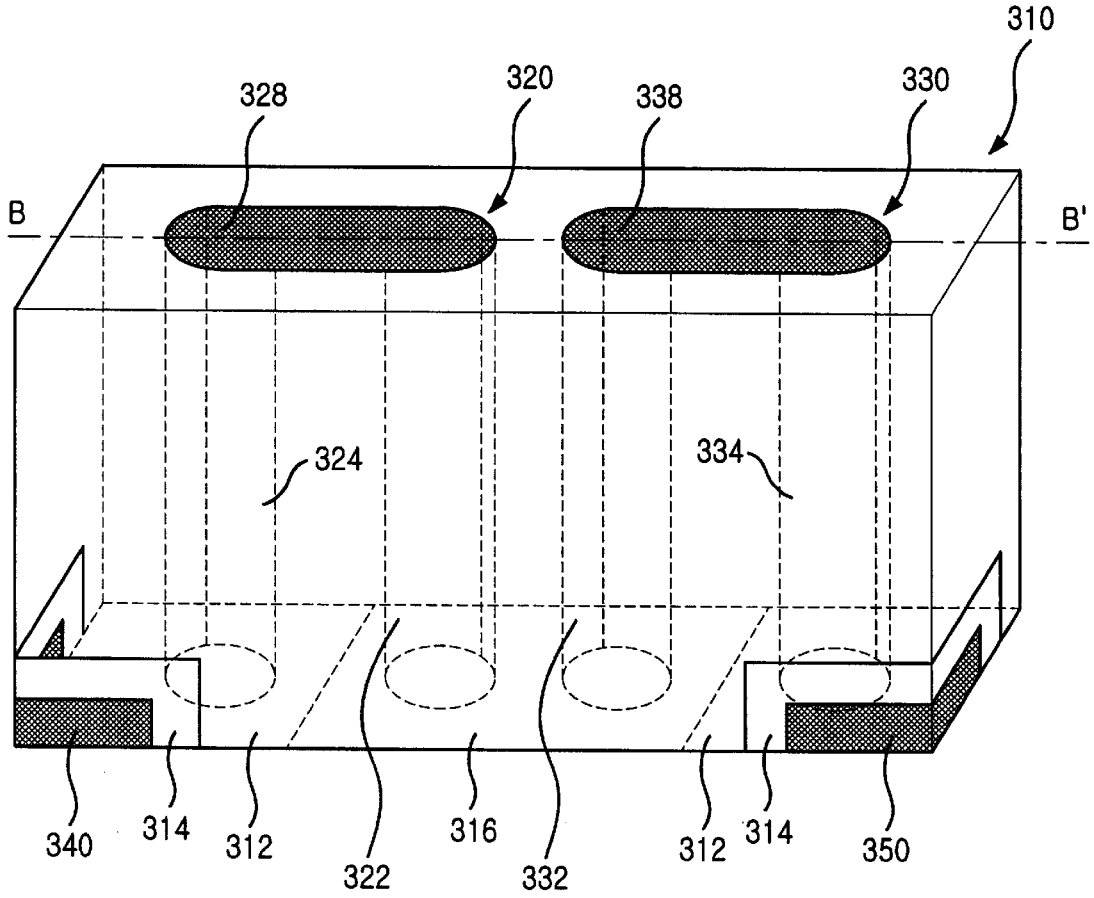
FIG. 6 is a perspective view showing modified resonator of the first embodiment.

FIG. 3 is a perspective view illustrating a dielectric filter having resonators arranged in series according to a first embodiment of the present invention, FIG. 4 is a cross-sectional view taken along longitudinal axis B–B' of the FIG. 3, FIG. 5 is a bottom view of the FIG. 3, and FIG. 6 is a perspective view showing modified resonators of the first embodiment according to the present invention.

As shown in FIGS. 3 to 5, the dielectric filter of the first embodiment includes a hexahedral dielectric block 310, and first and second resonators 320 and 330 serially formed within the dielectric block 310.

The dielectric block 310 has coated portions formed by coating with conductive metal. In the first embodiment, the coated portions of the dielectric block 310 are the rest portions except the top surface, both edge portions 312 of the bottom surface, and lower portions 314 of the side surface. That is, the coated portions of the dielectric block 310 are a portion of side surface and a center portion 316 of the bottom surface (see FIG. 5). Each of the non-coated portions 314 of the side surface are positioned adjacent to each of the non-coated portions 312 of the bottom surface.

The first resonator 320 has a first and second through holes 322 and 324 and a groove 326 for electrically coupling the upper end of the first through hole 322 to the upper end of the second through hole 324. Also, the second resonator 330 has a first and second through holes 332 and 334 and a groove 336 for electrically coupling the upper end of the first through hole 332 to the upper end of the second through hole 334.

The through holes 322, 324, 332 and 334 are vertically formed through the dielectric block 310 and are serially arranged along the longitudinal axis B–B' of the dielectric block 310. Therefore, the grooves 326 and 336 are also arranged in series along the longitudinal axis B–B'. Further, all inner walls of the holes and grooves are coated with conductive metal. Therefore, each of the first and second resonators 320 and 330 substantially takes the shape of alphabet "U" (see FIG. 4). Also, total length of each of the resonators 320 and 330, summing length of each of the first and second through holes and the groove, is substantially equal to ¼ wavelength, so that each of the resonators 320 and 330 functions as ¼ wavelength resonator.

At this time, the lower ends of the first through holes 322 and 332 are positioned in the coated center portion 316 of the bottom surface, and the lower ends of the second through holes 324 and 334 are respectively positioned in the non-coated portions 312 of the bottom surface. Therefore, the first through holes 322 and 332 of the resonators are coupled to a ground plane at the coated portion 316 of the bottom surface, thereby forming short-circuited ends. Also, the second through holes 324 and 334 of the resonators are coupled to the non-coated portions 312 of the bottom surface, thereby forming opened ends. In this case, each of the resonators 320 and 330 forms the most powerful electric field at peripheral portion of the opened end, and forms the most powerful magnetic field at peripheral portion of the short-circuited end. On the contrary, the electric field is "zero(0)" at peripheral portion of the short-circuited ends of the resonators 320 and 330, and the magnetic field is minimized at peripheral portion of the opened ends of the resonators 320 and 330. Therefore, since the first and second resonators 320 and 330 are coupled to each other by the magnetic field between the first through holes 322 and 332, the dielectric filter of the first embodiment may improve attenuation characteristic in higher frequency band than pass band.

Also, the dielectric filter of the first embodiment has input and output terminals 340 and 350 respectively disposed within the non-coated portions 314 of the side surface. The non-coated portions 314 of the side surface prevent the input and output terminals 340 and 350 from short-circuited to the ground plane. At this time, the input and output terminals 340 and 350 are respectively positioned adjacent to the opened ends, i.e., the second through holes 324 and 334 of the first and second resonators 320 and 330.

An operation of the dielectric filter according to the first embodiment of the present invention will be described in detail referring to the accompanying drawings.

When a signal is inputted into the dielectric block 310 through the input terminal 340, the inputted signal is transmitted to the second through hole 324 of the first resonator 320 and, then, to the first through hole 322 of the first resonator 320 passing through the groove 326. Thereafter, the signal transmitted to the first through hole 322 is transmitted to the first through hole 332 of the second resonator 330 by magnetic coupling and, then, to the second through hole 334 of the second resonator 330 passing through the groove 336. At this time, the signal transmitted to the second resonator 330 is transmitted to the output terminal 350.

Further, each of the resonators 320 and 330 may be manufactured so that a size of the first through hole differs from that of the second through hole. In this case, since the characteristic impedance in the short-circuited end differs from the characteristic impedance in the opened end, the resonators of the present invention come to SIR(Stepped Impedance Resonator).

Hereafter, features of the dielectric filter applying general SIR will be described, using odd mode and even mode admittance. At this time, coupling relationship between the SIRs may be represented by means of following Eq. (1).

$$\begin{bmatrix} -j\frac{y_2}{2}\{B_o(f)+B_e(f)\} & -j\frac{y_2}{2}\{B_o(f)-B_e(f)\} \\ -j\frac{y_2}{2}\{B_o(f)-B_e(f)\} & -j\frac{y_2}{2}\{B_o(f)+B_e(f)\} \end{bmatrix} \quad \text{Eq. (1)}$$

where, the $y_2$ is an odd mode admittance of opened end of the SIR, the $B_o$ (f) is a susceptance of the SIR representing by using of the odd mode admittance, and the $B_e$ (f) is a susceptance of the SIR representing by using of the even mode admittance. Through the Eq.(1), when a plurality of parameters(i.e. characteristic impedance of peripheral portions of the opened ends and short-circuited ends, and length of the coupled resonators) is adjusted, it is noted that an attenuation pole intercepting signal in higher frequency and lower frequency than pass band of the filter is developed.

Therefore, when the dielectric filter of the present invention is manufactured so that a size of each of the short-circuited through holes is larger than that of each of the opened through holes, the attenuation characteristic in higher frequency than the pass filter may be improved because the attenuation pole exists in the higher frequency.

Hereafter, the other embodiments of the dielectric filter according to the present invention will be described in detail referring to FIGS. 7 to 12. At this time, the description for portions similar to the first embodiment will be schematically described and reference numerals for the similar portions will use them of the first embodiment.

Figure 7:
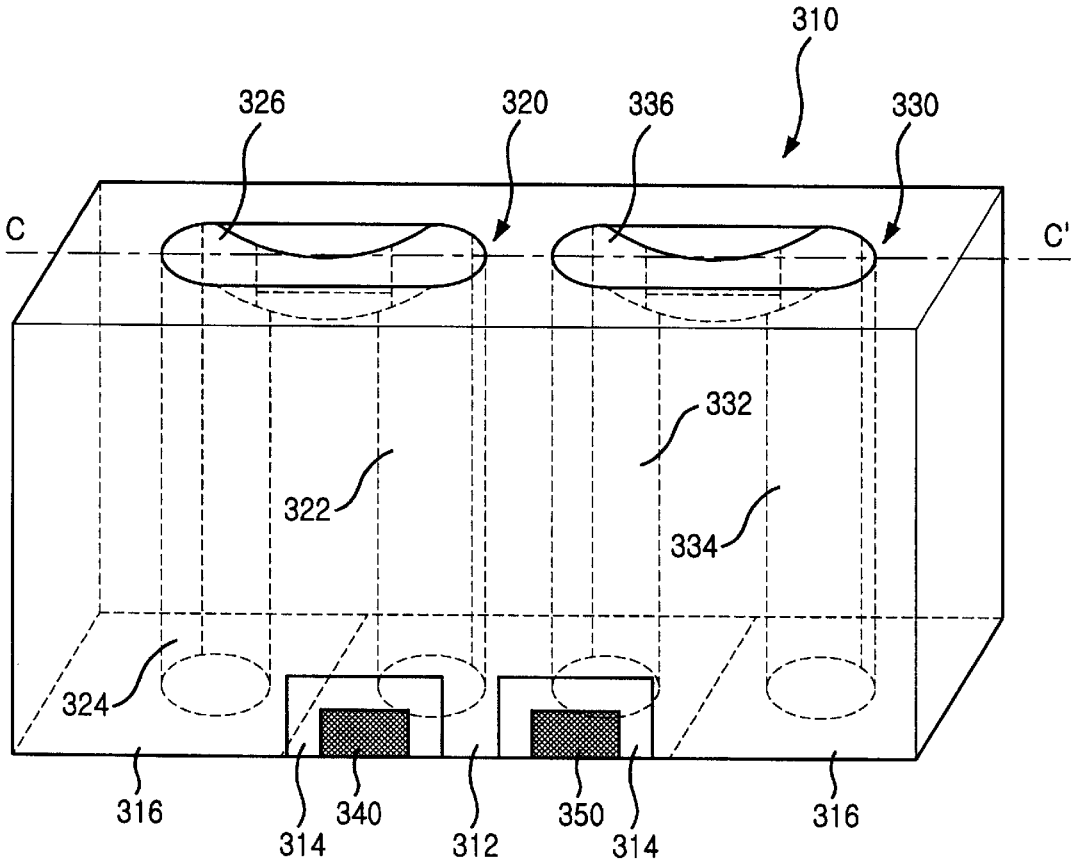
FIG. 7 is a perspective view illustrating a dielectric filter having resonators arranged in series according to a second embodiment of the present invention.
Figure 8:
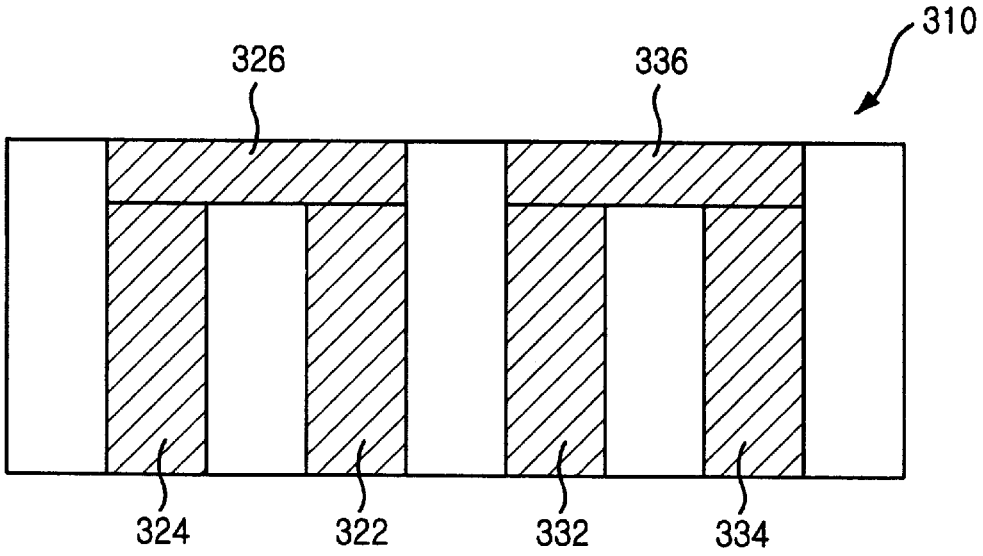
FIG. 8 is a cross-sectional view taken along longitudinal axis C–C' of the FIG. 7.
Figure 9:
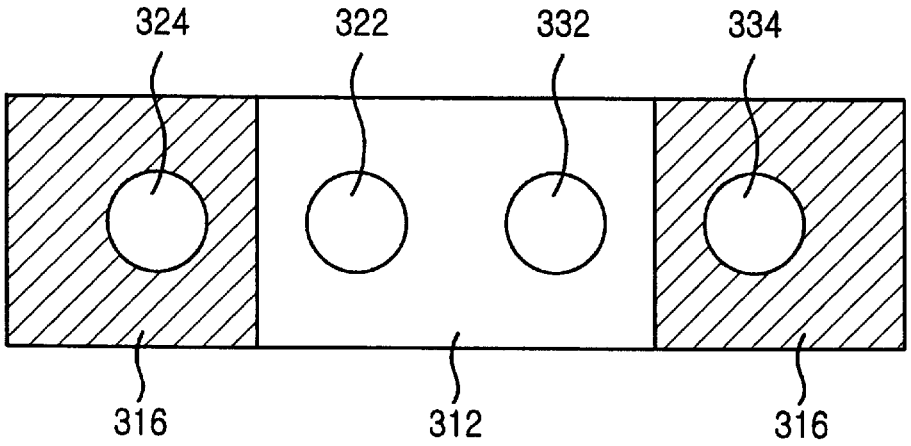
FIG. 9 is a bottom view of the FIG. 7.
Figure 10:
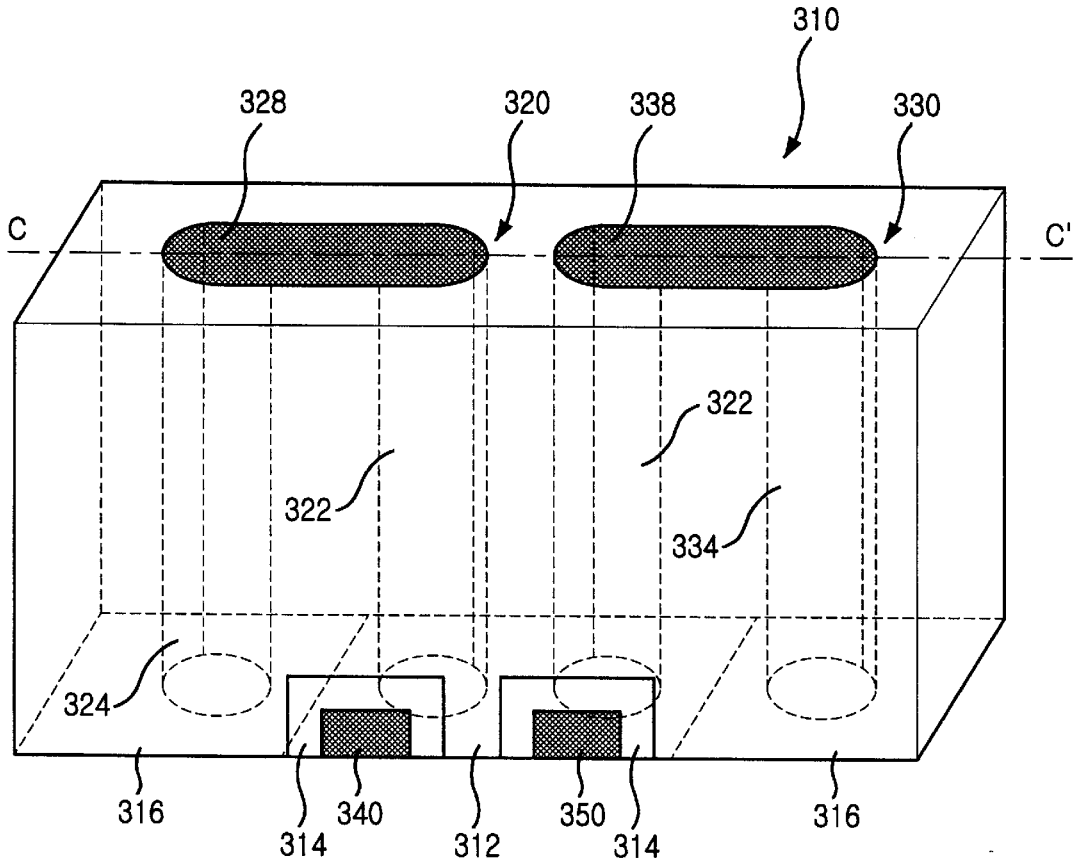
FIG. 10 is a perspective view showing modified resonator of the second embodiment.

FIG. 7 is a perspective view illustrating a dielectric filter having resonators arranged in series according to a second embodiment of the present invention, FIG. 8 is a cross-sectional view taken along longitudinal axis C–C' of the FIG. 7, FIG. 9 is a bottom view of the FIG. 7, FIG. 10 is a perspective view showing modified resonator of the second embodiment.

As shown in FIG. 7, the dielectric filter of the second embodiment includes a dielectric block 310, a plurality of resonators 320 and 330 serially arranged within the dielectric block 310, and an input and output terminals 340 and 350.

In the second embodiment, coated portions 316 of the bottom surface of the dielectric block 310 are respectively positioned at both edges of the bottom surface and non-coated portion 312 of the bottom surface of the dielectric block 310 is positioned at center portion of the bottom surface. At this time, the first through holes 322 and 332 of the resonators 320 and 330 respectively function as an opened end, and the second through holes 324 and 334 respectively function as a short-circuited end. Therefore, the resonators 320 and 330 are coupled by electric field.

Further, non-coated portions 314 of side surface, for positioning the input and output terminals 340 and 350, are positioned adjacent to central non-coated portion 312 of the bottom surface. Therefore, the input terminal 340 is positioned adjacent to the first through hole 322 of the first resonator 320 and the output terminal 350 is positioned adjacent to the first through hole 332 of the second resonator 330.

The dielectric filter of the second embodiment also is ¼ wavelength such as the filter of the first embodiment.

Furthermore, when the filter of the second embodiment is manufactured so that a size of each of the opened through holes 322 and 332 is larger than that of each of the short-circuited through holes 324 and 334, the filter of the second embodiment may be improved an attenuation characteristic in lower frequency than the pass band because an attenuation pole exists in lower frequency than the pass band.

An operation of the filter according to the second embodiment constructed as above-mentioned is similar to that of the filter according to the first embodiment.

Figure 11:
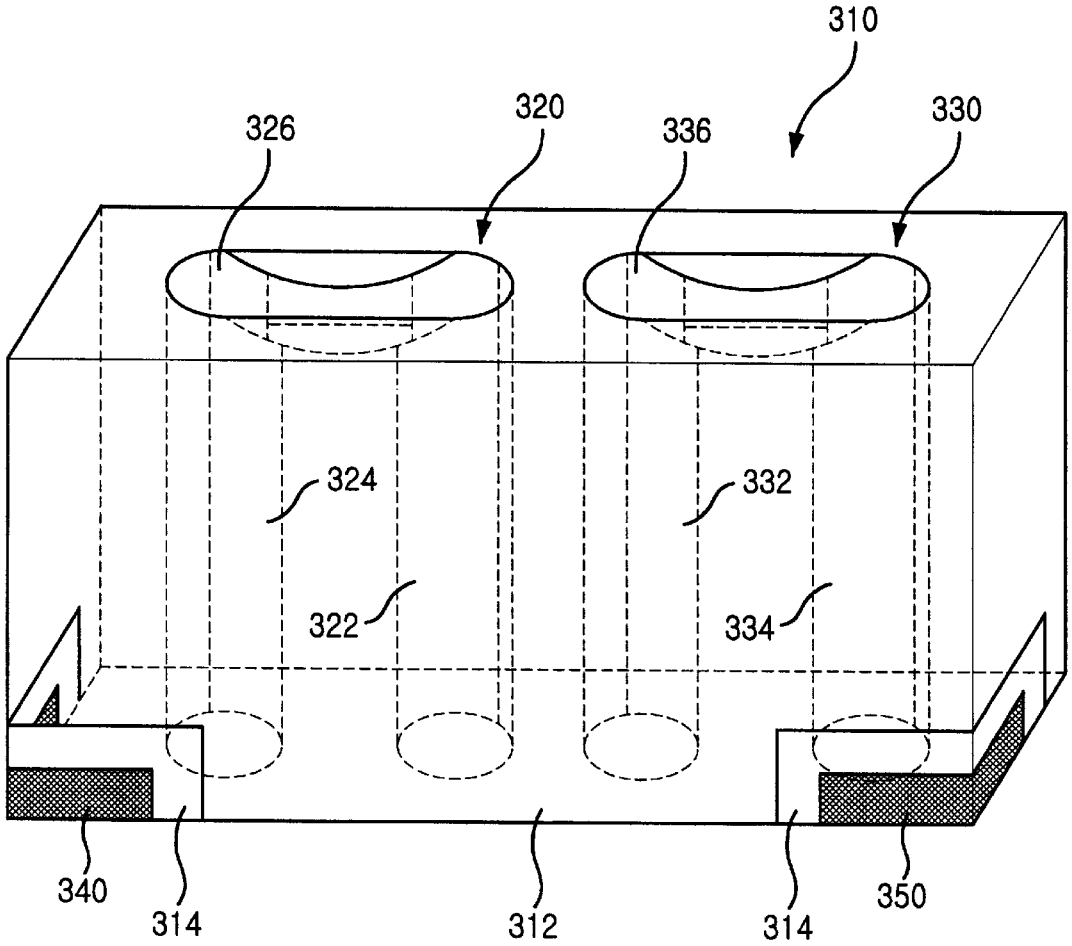
FIG. 11 is a perspective view illustrating a dielectric filter having resonators arranged in series according to a third embodiment of the present invention.
Figure 12:
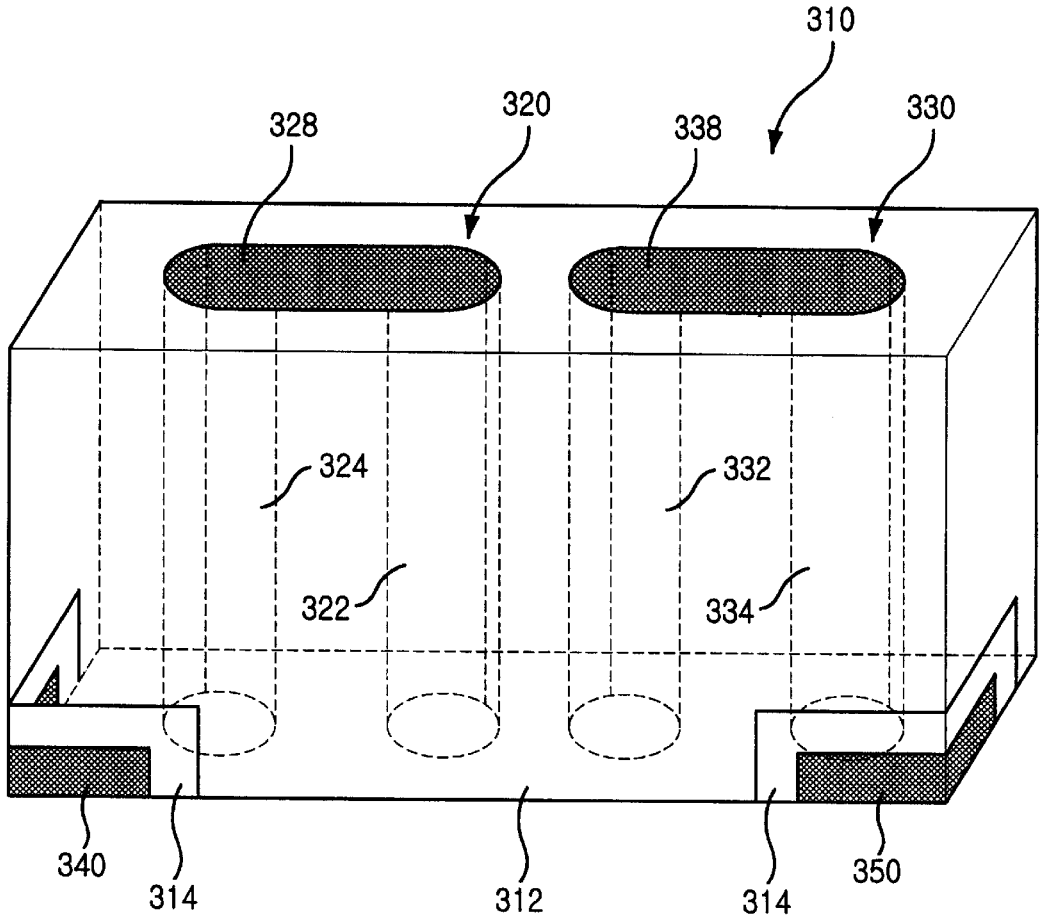
FIG. 12 is a perspective view showing modified resonator of the third embodiment.

FIG. 11 is a perspective view illustrating a dielectric filter having resonators arranged in series according to a third embodiment of the present invention, FIG. 12 is a perspective view showing modified resonator of the third embodiment.

In the third embodiment, the bottom surface of the dielectric block 310 is not coated with the conductive metal. That is, the bottom surface is a non-coated portion 312. Therefore, since the other ends of the first and second through holes of the resonators are opened ends, each of the resonators 320 and 330 of the third embodiment functions as a ½ wavelength resonator.

In this case, the dielectric filter of the third embodiment forms most powerful electric field at both sides of the resonators 320 and 330, and forms virtual ground at center portion between the first and second resonators 320 and 330. Therefore, the center portion of the filter is a portion developing most powerful magnetic field. At this time, the filter of the third embodiment has a coupling characteristic by an electromagnetic field, thereby having symmetrical frequency characteristic. The filter according to the third embodiment, likewise the first and second embodiments, may be manufactured so that a size of the first through hole differs from that of the second through hole.

An operation of the filter according to the second embodiment constructed as above-mentioned is similar to that of the filter according to the first embodiment.

Further, in the first to third embodiments, the grooves 326 and 336 may be substituted for electrode pattern. That is, as shown in FIGS. 6, 10, and 12, the groove 326 of the first resonator 320 is substituted for electrode pattern 328 and the groove 336 of the second resonator 330 is substituted for electrode pattern 338.

As above-described, the dielectric filter according to the present invention can decrease the mounted height by serially arranging the resonators and improve an attenuation characteristic in a stop band.

While the present invention has been described with respect to certain preferred embodiments only, other modifications and variation may be made without departing from the spirit and scope of the present invention as set forth in the following claims.

What is claimed is:

1. A dielectric filter having resonators arranged in series, comprising:

a dielectric block; and a plurality of U-Shaped resonating means formed within said dielectric block, each of said resonating means having first and second through holes formed vertically through said dielectric block and arranged in series along longitudinal axis of said dielectric block and a coupling portion formed on top surface of said dielectric block and electrically connecting an end of the first through hole to an end of the second through hole, wherein said plurality of resonating means are serially arranged along the longitudinal axis.

2. The dielectric filter as recited in claim 1, wherein said dielectric block has coated portions, wherein the coated portions are formed by coating the rest portions except the top surface of said dielectric block, and a predetermined portions of the bottom and side surfaces of said dielectric block with conductive material, and wherein the non-coated portions of the side surface is positioned adjacent to the non-coated portion of the bottom surface.

3. The dielectric filter as recited in claim 2, further including input and output terminals respectively positioned within the non-coated portions of the side surfaces.

4. The dielectric filter as recited in claim 3, wherein the total length of each of said resonating means, summing length of each of the first and second through holes and the coupling portion, is substantially equal to ¼ wavelength.

5. The dielectric filter as recited in claim 4, wherein a size of the first through hole is different from that of the second through hole.

6. The dielectric filter as recited in claim 5, wherein the size of the first through hole is larger than that of the second through hole.

7. The dielectric filter as recited in claim 6, wherein the center portion of the bottom surface, which the first through holes are positioned therein, is coated portion.

8. The dielectric filter as recited in claim 7, wherein each of the coupling portions includes a groove formed on the top surface of said dielectric block and coated inner wall thereof with conductive material.

9. The dielectric filter as recited in claim 7, wherein each of the coupling portions includes an electrode pattern formed on the top surface of said dielectric block.

10. The dielectric filter as recited in claim 6, wherein both edges of the bottom surface, which the second through holes are positioned therein, are coated portions.

11. The dielectric filter as recited in claim 10, wherein each of the coupling portions includes a groove formed on the top surface of said dielectric block and coated inner wall thereof with conductive material.

12. The dielectric filter as recited in claim 10, wherein each of the coupling portions includes an electrode pattern formed on the top surface of said dielectric block.

13. The dielectric filter as recited in claim 1, wherein said dielectric block has coated portions, wherein the coated portions are formed by coating the rest portions except the top and bottom surfaces of said dielectric block and a portions of the side surface of said dielectric block with conductive material, and wherein the non-coated portions of the side surface are positioned adjacent to the bottom surface.

14. The dielectric filter as recited in claim 13, further including input and output terminals respectively positioned within the non-coated portions of the side surfaces.

15. The dielectric filter as recited in claim 14, wherein the total length of each of said resonating means, summing length of each of the first and second through holes and the coupling portion, is substantially equal to ½ wavelength.

16. The dielectric filter as recited in claim 15, wherein a size of the first through hole is different from that of the second through hole.

17. The dielectric filter as recited in claim 16, wherein each of the coupling portions includes a groove formed on the top surface of said dielectric block and coated inner wall thereof with conductive material.

18. The dielectric filter as recited in claim 16, wherein each of the coupling portions includes an electrode pattern.

* * * * *